US010961080B1

(12) United States Patent
Young

(10) Patent No.: US 10,961,080 B1
(45) Date of Patent: Mar. 30, 2021

(54) HOSE OR CABLE REEL WINDER

(71) Applicant: William Young, Rancho Cucamonga, CA (US)

(72) Inventor: William Young, Rancho Cucamonga, CA (US)

( * ) Notice: Subject to any disclaimer, the term of this patent is extended or adjusted under 35 U.S.C. 154(b) by 0 days.

(21) Appl. No.: 17/107,489

(22) Filed: Nov. 30, 2020

(51) Int. Cl.
*B65H 75/44* (2006.01)

(52) U.S. Cl.
CPC ..... *B65H 75/4402* (2013.01); *B65H 75/4473* (2013.01); *B65H 2701/33* (2013.01); *B65H 2701/34* (2013.01)

(58) Field of Classification Search
CPC ..... B65H 75/4402; B65H 75/4473; B65H 2701/33; B65H 2701/34
See application file for complete search history.

(56) References Cited

U.S. PATENT DOCUMENTS 848,239 A 3/1907 Grimsrub
2,274,330 A * 2/1942 Hammond ..... H02G 11/02 200/545
2,299,521 A 10/1942 Zierden
3,840,713 A 10/1974 Charpentier
4,660,782 A 4/1987 Hegemann
5,230,480 A 7/1993 Perry
5,797,424 A * 8/1998 Tisbo ..... B65H 75/40 137/315.01
6,491,249 B2 * 12/2002 Park ..... A47L 9/26 242/386
6,971,605 B1 12/2005 Martin
7,017,603 B1 3/2006 Rosine
2012/0256033 A1 10/2012 Blaszczak

* cited by examiner

*Primary Examiner* — Sang K Kim
(74) *Attorney, Agent, or Firm* — Averill & Green; Kenneth L. Green

(57) ABSTRACT

A hose or cable reel winder provides a handle for winding hose or cable onto a stationary reel and facilitates an orderly winding onto the reel. A guide is attached to an arm and the arm is free to rotate with respect to the stationary reel. The handle rotates in the guide allowing a user to wind hose or cable onto the stationary reel, and slides into and out of the guide to facilitate the orderly winding of the hose or cable onto the reel. The stationary reel does not require couplings between fixed source hoses or cables and a rotating reel, and allows releasing and collecting pairs or groups of hoses or cables.

18 Claims, 2 Drawing Sheets

HOSE OR CABLE REEL WINDER

BACKGROUND OF THE INVENTION

The present invention relates to reels for storing hose and cables and in particular to an improved winder.

Hoses and cables are often stored on reels and frequently drawn from and returned to the reels, for example gas welding hoses. Such hoses may not tend to wind in an orderly manner, and require additional space, sometimes more space than available on the reel.

US Patent No. 848,239 for "Hose Reel" discloses a hose reel with a crank and a hose guide 11. The guide engages grooves in a drum to move the guide up and down to guide the hose onto the drum. Unfortunately, the hose reel of the '239 patent is only suitable for a single hose size.

U.S. Pat. No. 3,840,713 for "Portable Reel for Flexible Conductors" discloses a guide 42 attached to an arm that rotates with the reel. Unfortunately the '713 does not allow guiding the flexible conductor in an orderly manner.

U.S. Pat. No. 6,971,605 for "Device for Winding/Taking Up Cables, Ribbons, or Other Coilable Structures" discloses a handle 134 and a driven guide 114 guiding a hose axially onto the reel. A threaded first track 118 coupled to a rotating drive 122, engages and drives the cable guide 114 controlling the winding of hose or cable onto the reel. Unfortunately, the hose reel of the '605 patent is only suitable for a single hose size. The 605 patent provides a handle to wind the reel, but does not facilitate an orderly winding onto the reel.

Many uses of hoses or cables requires a pair or multiple hoses or cables, such as acetylene welding hoses, or arc welding when a ground cable is required. Some uses also require electrical connections released or collected with the hoses. Known reels are not well suited to such pairs of cables and/or additional wiring.

Known reels rotate to release or collect hoses and cables. Such rotation requires a coupler between a fixed source hose or able and the hose or cable on the rotating reel. Such couplings add a failure mode and require maintenance.

The prior art thus fails to provide a simple device allowing a user to release and collect any size hose or cable, or groups of hoses or cables, onto a reel in an orderly manner while avoiding couplings between fixed source hoses and cables and hoses or cables released and collected on the reel.

BRIEF SUMMARY OF THE INVENTION

The present invention addresses the above and other needs by providing a hose or cable reel winder which provides a handle for winding hose or cable onto a stationary reel and facilitates an orderly winding onto the reel. A guide is attached to an arm and the arm is free to rotate with respect to the stationary reel. The handle rotates in the guide allowing a user to wind hose or cable onto the stationary reel, and slides into and out of the guide to facilitate the orderly winding of the hose or cable onto the reel. The stationary reel does not require couplings between fixed source hoses or cables and a rotating reel, and allows releasing and collecting pairs or groups of hoses or cables.

In accordance with one aspect of the invention, there is provided a hose or cable reel winder including a stationary reel. The stationary reel removes a need for couplings which may leak and require maintenance.

In accordance with another aspect of the invention, there is provided a hose or cable reel winder allowing multiple hoses and cables to be easily fed into the winder and connected directly to sources.

BRIEF DESCRIPTION OF THE SEVERAL VIEWS OF THE DRAWING

The above and other aspects, features and advantages of the present invention will be more apparent from the following more particular description thereof, presented in conjunction with the following drawings wherein.

Corresponding reference characters indicate corresponding components throughout the several views of the drawings.

DETAILED DESCRIPTION OF THE INVENTION

The following description is of the best mode presently contemplated for carrying out the invention. This description is not to be taken in a limiting sense, but is made merely for the purpose of describing one or more preferred embodiments of the invention. The scope of the invention should be determined with reference to the claims.

Where the terms "about" or "generally" are associated with an element of the invention, it is intended to describe a feature's appearance to the human eye or human perception, and not a precise measurement, or typically within 10 percent of a stated value.

Figure 1A:
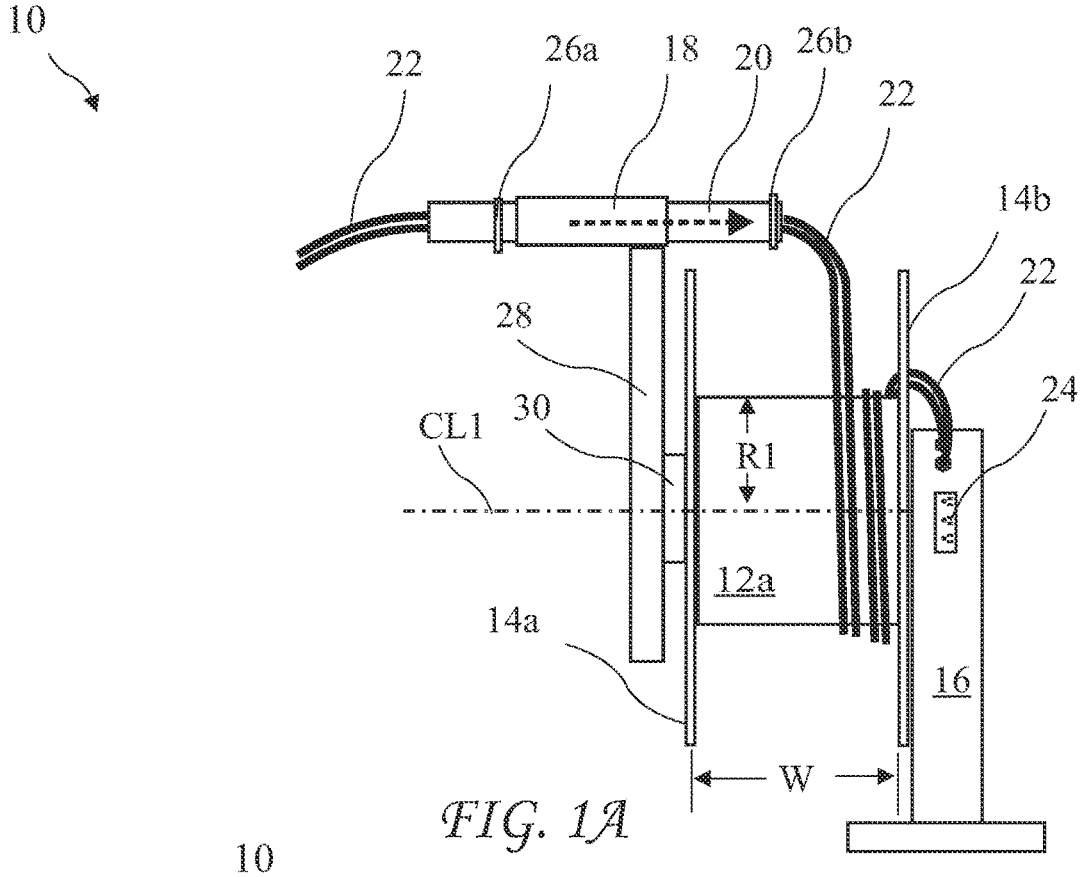
FIG. 1A shows a side view of a reel winder and two hoses or cables wound twice onto a reel according to the present invention.
Figure 1B:
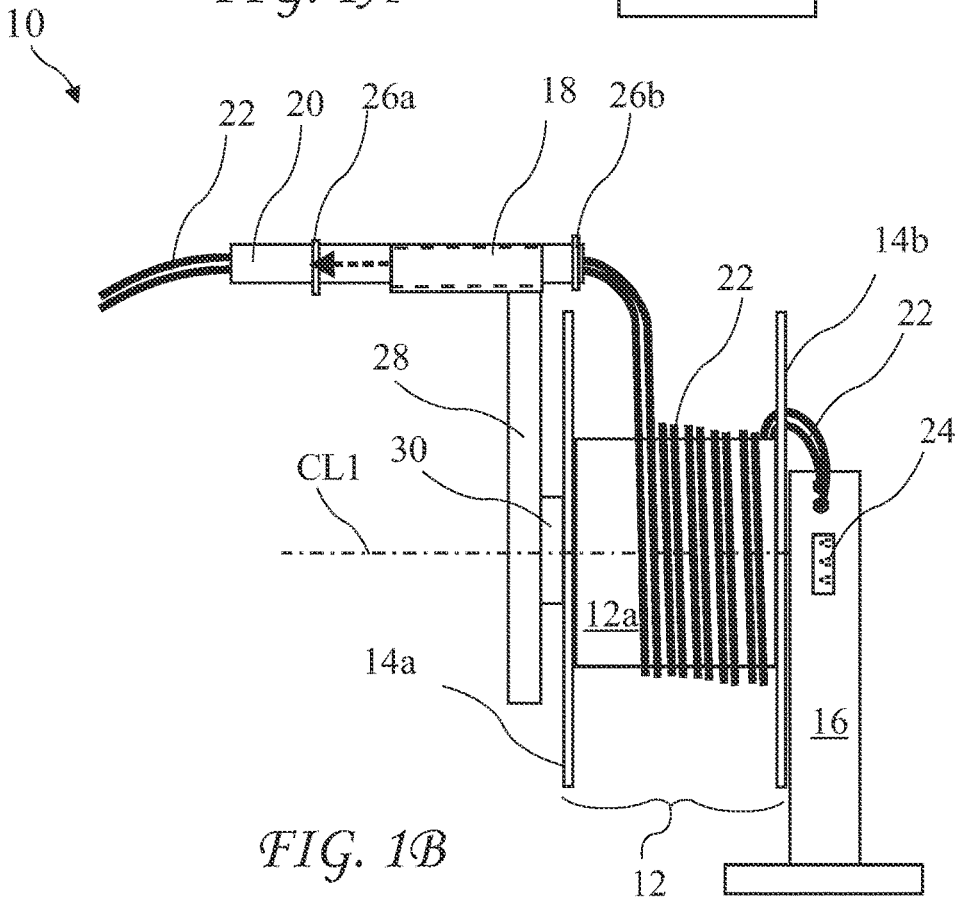
FIG. 1B shows a side view of the reel winder and two hoses or cables wound five times onto the reel according to the present invention.

A side view of a reel winder 10 with a handle 20 in a first position and two hoses or cables 22 wound twice onto a reel 12 is shown in FIG. 1A, and a side view of the reel winder 10 with the handle 20 in a second position and two hoses or cables 22 wound five times onto the reel 12, is shown in FIG. 1B. The reel winder 10 includes the cylindrical reel center 12*a*, and an outer reel rim 14*a* and inner reel rim 14*b* fixed to a stanchion 16. The stanchion 16 is generally attached to a fixed platform, a table, a vehicle, or the like. The cylindrical reel center 12*a*, and an outer reel rim 14*a* and inner reel rim 14*b* do not rotate. The cylindrical reel center 12*a* has a centerline CL1, a width W of preferably between four and ten inches and more preferably about six inches, and radius R1 of preferably between two and ten inches and more preferably about three inches.

An arm 28 is attached to the outer rim 14*a* or cylindrical center 12 through a bearing 30 allowing the arm 28 to rotate about an axis substantially aligned with the centerline CL1. The substantial alignment is sufficient to prevent the arm from contacting the outer rim 14*a* when the arm 28 is rotated. A handle guide 18 is attached to the arm 28 at a radius with respect to the centerline CL1 beyond the perimeter of the outer rim 14*a*.

A handle 20 slides and rotates inside the handle guide 18, preferably freely. The hoses or cables 22 attach to the stanchion 16 and pass through a notch or passage 32 (See FIG. 3) in the inner rim 14*b* and onto the cylindrical center 12, and then through the handle 20. In the first position, the handle 20 is closer to the inner rim 14*b* and guides the hoses or cables 22 to wind close to the inner rim 14*b*. In the second position, the handle 20 is pulled away from the inner rim 14*b* and guides the hoses or cables 22 to wind away from the inner rim 14*b*. The hoses or cables 22 may be drawn from the reel winder 10 by pulling the hoses or cables 22 out through the handle 20, and the sliding handle 20 may be turned to wind the hoses or cables 22 back onto the cylindrical center 12 and the handle 18 slid in the handle guide to provide an orderly winding onto the cylindrical center 12. Wiring may be connected to outlets 24 on the stanchion 16 and the wires wound in the same manner as the hoses or cables 22. Fluid, gas, or electrical sources may be fed to the stanchion 16 and to the hoses or cables 22 or outlets 24. The handle 20 slides without restriction in the handle guide 18 allowing the user to orderly guide any size horse or cable, or multiple hoses and cables 22, onto the cylindrical center 12.

Figure 2:
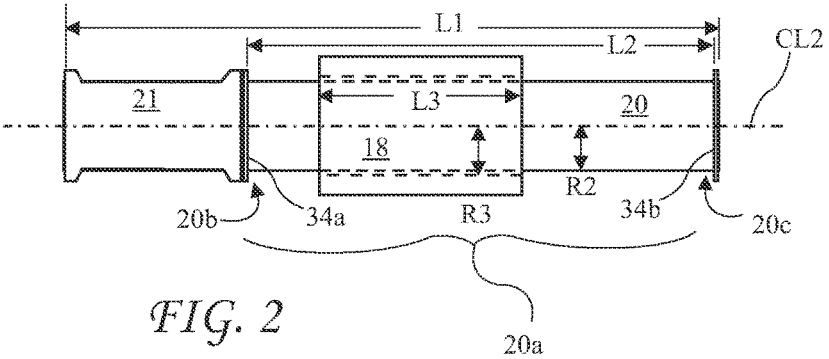
FIG. 2 shows a handle and handle guide of the reel according to the present invention.

The handle 20 and handle guide 18 are shown in FIG. 2. The handle 20 has a cylindrical center portion 20*a*, an outer end 20*b*, an inner end 20*c*, and a grip 21 outside the outer end 20*b*. The handle 20 preferably has an overall length L1 between 10 and 21 inches and more preferably about 14.5 inches. The center portion 20*a* preferably has a length L2 between 7 and 16 inches and more preferably about 10 inches and a radius between one half and two inches and more preferably about 1.5 inches. The handle guide 18 has a length preferably between three and six inches and more preferably 4.25 inches and an inside radius between one half and two inches and more preferably about 1.5 inches. The radius of the handle center portion 20*a* is slightly smaller than the inside radius of the handle guide 18 allowing the handle 20 to rotate and slide in the handle guide 18.

An outside stop 34*a* resides at an outside end 20*b* of the handle center portion 20*a* and an inside stop 34*b* resides at an inside end 20*c* of the handle center portion 20*a*. The stops 34*a* and 34*b* limit the sliding of the handle 20 on the handle guide 18. The inside stop 34*b* may be an outside snap ring, a ring pressed onto the handle 20, a ring welded or glued to the handle 20, or may be machined onto the handle 20. The outside stop 34*a* may be an end of a grip 21, an outside snap ring, a ring pressed onto the handle 20, a ring welded or glued to the handle 20, or may be machined onto the handle 20.

Figure 3:
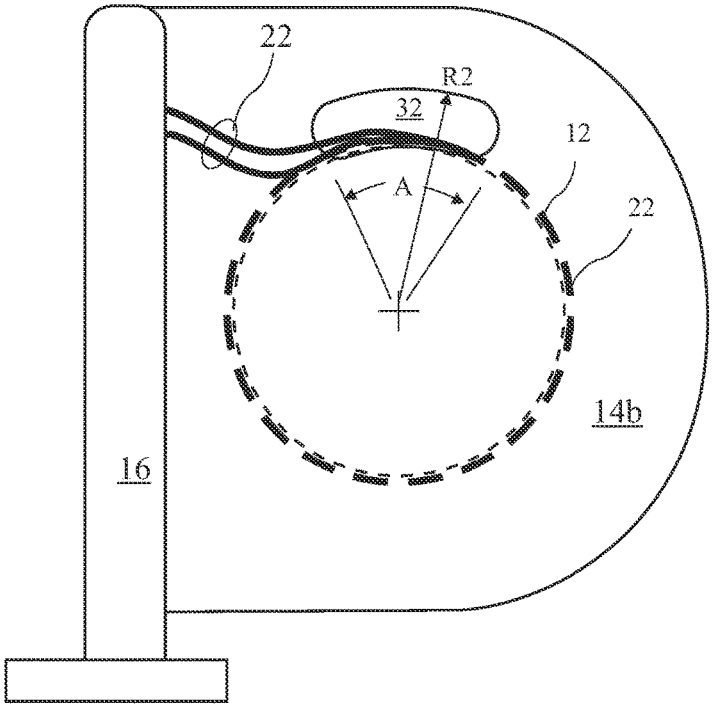
FIG. 3 shows a stanchion end view of the reel according to the present invention.

FIG. 3 shows a stanchion 16 end view of the reel 10. The inner reel rim 14*b* is attached to the stanchion 16 and does not rotate with respect to the stanchion 16. The passage 32 provides an opening for the hoses or cables 22 to enter the reel and wind around the cylindrical center 12. The passage 32 has is preferably an arc shape with an inner radius of the same first radius R1 of the cylindrical center 12, and an outer second radius R2 between preferably between one and two inches greater than the cylindrical center 12 first radius (R1), and more preferable about 1.5 inches greater than the cylindrical center 12 first radius (R1). The passage 32 preferably has an angular extent A between 30 and 90 degrees and more preferably between 30 and 75 degrees, and most preferably an angular extent A of about 60 degrees.

Figure 4:
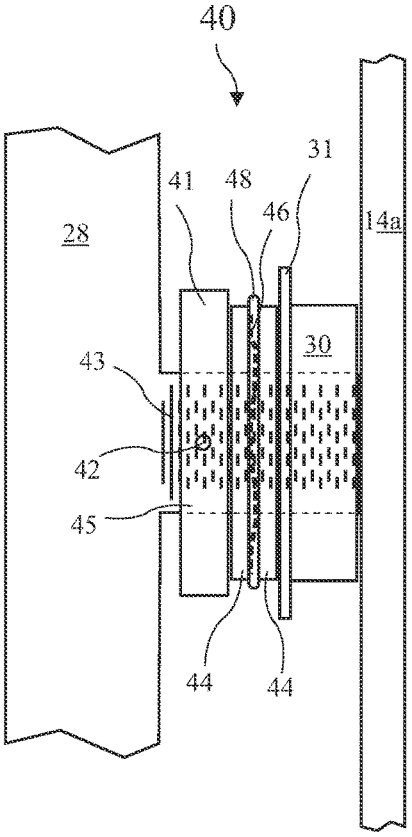
FIG. 4 shows a tension plate between the handle and reel according to the present invention.

A tension plate assembly 40 residing between the arm 28 and outer reel rim 14*a* is shown in FIG. 4. The tension plate assembly 40 is adjustable to provide resistance to free motion of the arm which may allow the hose or cable 22 to unintentionally unwind. The tension plate assembly 40 includes a finger spring 46 captured between two washers 44, and surrounded by an O-ring 48. A threaded adjusting nut 41 engages threads 43 on a hub portion 45 of the arm 28 and is locked by a set screw 42, pressing the two flat washers 44 between the nut 41 and a ring 31 together allowing adjusting the resistance to free rotation of the arm 28.

While the invention herein disclosed has been described by means of specific embodiments and applications thereof, numerous modifications and variations could be made thereto by those skilled in the art without departing from the scope of the invention set forth in the claims.

I claim:

1. A cable or hose reel comprising:
- a stanchion;
- a non-rotating reel fixed to the stanchion, the reel comprising:
  - an inner rim residing proximal to the stanchion;
  - a cylindrical reel center attached to the inner rim, the cylindrical reel center having a first radius (R1) and a first centerline (CL1); and
  - an outer rim attached to the cylindrical reel center on a side opposite to the inner rim;
- an arm attached to the reel outside the outer rim, opposite to the stanchion, and free to rotate;
- a handle guide attached to an end of the arm and radially outside the outer rim; and
- a hollow handle residing through the handle guide and free to rotate in the handle guide and to slide axially in the handle guide.

2. The reel of claim 1, further including a passage through the inner rim at a radius greater than a radius (R1) of the cylindrical reel center.

3. The reel of claim 2, wherein the passage is arc shaped.

4. The reel of claim 3, wherein the passage has an outer radius (R2) between one and two inches greater than the cylindrical reel center radius (R1).

5. The reel of claim 3, wherein the passage has an outer radius (R2) of about 1.5 inches greater than the cylindrical reel center radius (R1).

6. The reel of claim 3, wherein the passage has an angular extent (A) between 30 and 75 degrees.

7. The reel of claim 3, wherein the passage has an angular extent (A) of about 60 degrees.

8. The reel of claim 2, further including hose or cable connecters attached to the stanchion.

9. The reel of claim 8, further including electrical connecters attached to the stanchion.

10. The reel of claim 1, wherein the handle guide is cylindrical with a centerline (CL2) parallel to the first centerline (CL1).

11. The reel of claim 10, wherein the handle guide has a length L3 of between three and five inches and an inside diameter between one and two inches.

12. The reel of claim 10, wherein the handle guide has a length L3 of about 4.25 inches and an inside diameter about 1.5 inches.

13. The reel of claim 1, wherein the handle comprises:
- an inner end residing over the cylindrical reel center;
- an outer end opposite to the inner end and extending out from the handle guide;
- a cylindrical portion sliding and rotating inside the handle guide; and
- a grip portion extending from the cylindrical portion and outside the outer end.

14. The reel of claim 1, wherein the handle includes a cylindrical portion residing in the handle guide and stops comprising:
- an increased radius inner stop having a greater radius than the cylindrical portion at an inner end residing over the cylindrical reel center; and an increased radius outer stop having a greater radius than the cylindrical portion at an outer end opposite to the inner end and extending out from the handle guide.

15. The reel of claim 14, wherein the outer stop is a grip portion.

16. The reel of claim 1, further including a tension plate between the arm and outer rim, the tension plate resisting free rotation of the handle.

17. A cable or hose reel comprising:

a stanchion;

a non-rotating reel fixed to the stanchion, the reel comprising:

an inner rim residing proximal to the stanchion;

a cylindrical reel center attached to the inner rim, the cylindrical reel center having a first radius (R1) and a first centerline (CL1);

an outer rim attached to the cylindrical reel center on a side opposite to the inner rim; and an arced passage through the inner rim having an inner radius equal to the radius (R1) of the cylindrical reel center and an outer radius (R2) between one and two inches greater than the radius (R1) of the cylindrical reel center, and an angular extent (A) of between 30 and 90 degrees;

an arm attached to the reel outside the outer rim, opposite to the stanchion, and free to rotate;

a cylindrical handle guide attached to an end of the arm and radially outside the outer rim, the handle guide having a centerline (CL2) parallel to the first centerline (CL1); and a hollow handle residing through the handle guide and free to rotate in the handle guide and to slide axially in the handle guide.

18. A cable or hose reel comprising:

a stanchion;

a non-rotating reel fixed to the stanchion, the reel comprising:

an inner rim residing proximal to the stanchion;

a cylindrical reel center attached to the inner rim, the cylindrical reel center having a first radius (R1) and a first centerline (CL1);

an outer rim attached to the cylindrical reel center on a side opposite to the inner rim; and an arced passage through the inner rim having an inner radius equal to the radius (R1) of the cylindrical reel center and an outer radius (R2) 1.5 inches greater than the radius (R1) of the cylindrical reel center, and an angular extent (A) of 60 degrees;

an arm attached to the reel outside the outer rim, opposite to the stanchion, and free to rotate;

a cylindrical handle guide attached to an end of the arm and radially outside the outer rim, the handle guide having a centerline (CL2) parallel to the first centerline (CL1);

a hollow handle residing through the handle guide and free to rotate in the handle guide and to slide axially in the handle guide;

hose or cable connecters attached to the stanchion;

electrical connecters attached to the stanchion; and a tension plate between the arm and outer rim, the tension plate resisting free rotation of the handle.

* * * * *